US006735412B2

(12) United States Patent
Berg et al.

(10) Patent No.: US 6,735,412 B2
(45) Date of Patent: May 11, 2004

(54) CAPILLARY MICRO-GROOVE SKIVE FINGERS

(75) Inventors: Richard Hiram Berg, Rochester, NY (US); Gregory Leo Kowalski, Victor, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/264,946

(22) Filed: Oct. 4, 2002

(65) Prior Publication Data

US 2004/0067080 A1 Apr. 8, 2004

(51) Int. Cl.[7] ..... G03G 15/20
(52) U.S. Cl. ..... 399/323
(58) Field of Search ..... 399/323, 398, 399/399, 98, 327; 271/900

(56) References Cited

U.S. PATENT DOCUMENTS

| | | | | | |
|---|---|---|---|---|---|
| 3,844,252 | A | * | 10/1974 | Thettu | 399/323 |
| 3,881,859 | A | * | 5/1975 | Hamilton | 399/323 |
| 3,992,000 | A | * | 11/1976 | Martin | 399/323 |
| 4,052,150 | A | * | 10/1977 | Behun | 399/323 |
| 5,532,810 | A | * | 7/1996 | Cahill | 399/323 |

FOREIGN PATENT DOCUMENTS

| | | | | | |
|---|---|---|---|---|---|
| JP | 54050339 | A | * | 4/1979 | G03G/15/20 |
| JP | 56119163 | A | * | 9/1981 | G03G/15/20 |
| JP | 04179669 | A | * | 6/1992 | G03G/15/20 |
| JP | 05341686 | A | * | 12/1993 | G03G/15/20 |

OTHER PUBLICATIONS

Translation of JP 54–050339.*

* cited by examiner

*Primary Examiner*—Arthur T. Grimley
*Assistant Examiner*—Ryan Gleitz
(74) *Attorney, Agent, or Firm*—Lawrence P. Kessler

(57) ABSTRACT

With a fuser apparatus, for example having a pair of rollers in nip relation to transport a receiver member therebetween, to permanently fix a marking particle image to such receiver member, a skive mechanism for stripping a receiver member adhering to a fuser apparatus roller from the roller, and a mechanism for applying a release oil to the fuser rollers. The skive mechanism includes a plurality of skive fingers formed as elongated, thin, flexible members located so as to engage the fuser apparatus rollers in a manner so as to substantially prevent damage to such associated fuser apparatus rollers. Each of the skive fingers have capillary micro-grooves formed therein for the purpose of channeling release oil away from the respective skive finger tips, thereby substantially eliminating image degradation by build up of the release oil.

10 Claims, 10 Drawing Sheets

CAPILLARY MICRO-GROOVE SKIVE FINGERS

FIELD OF THE INVENTION

This invention relates in general to skive fingers for fuser apparatus of reproduction equipment, and more particularly to reproduction equipment fuser apparatus skives which have capillary micro-grooves to substantially prevent build up of image-degrading fluid on the fuser apparatus skive fingers.

BACKGROUND OF THE INVENTION

In typical commercial reproduction equipment (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction on the receiver member.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat applied in the roller nip. Under the pressure in the nip, the softened tacky marking particles attach to each other and are partially imbibed into the interstices of the fibers at the surface of the receiver member. Accordingly, upon cooling, the marking particle image is permanently fixed to the receiver member.

It sometimes happens that the marking particles stick to the peripheral surface of the heated roller and result in the receiver member adhering to such roller; or the marking particles may stick to the heated roller and subsequently transfer to the peripheral surface of the pressure roller resulting in a receiver member adhering to the pressure roller. It has therefore been a general practice to apply a release oil coating to elements of the fuser apparatus (e.g., the fuser roller and/or pressure roller). The release oil is selected to have properties, well known in the prior art, which will inhibit the sticking of marking particles to the fuser apparatus elements. However, the release oil is not completely effective in preventing receiver members from adhering to the fuser apparatus elements.

In view of the receiver member adherence problem, a skive mechanism, including mechanical skive fingers or separator pawls for example, has been employed to engage the respective peripheral surfaces of the fuser apparatus rollers to strip any adhering receiver member from the rollers in order to substantially prevent receiver member jams in the fuser apparatus. Typically a fuser apparatus skive mechanism includes a plurality of skive fingers. The skive fingers are generally formed as elongated members respectively having a relatively sharp leading edge urged into engagement with a fuser apparatus roller. For example, the skive fingers may be thin, relatively flexible, metal shim stock. The respective leading edge of each of the skive fingers is directed in the opposite direction to rotation of the fuser apparatus roller with which such skive finger is associated so as to act like a chisel to strip any receiver member adhering to such roller from the peripheral surface thereof.

Skive fingers, oriented as described, as currently found in exemplary fuser apparatus, have a tendency during operation of the reproduction equipment to become wetted with fuser release oil that accumulates on the fingers during the fusing process. The receiver members, bearing images to be reproduced, as they are released from the fuser, will come in contact with skive fingers as they are guided away from the fuser apparatus. The accumulated release oil then becomes wetted to the receiver members during such contact, and the oil is transported back through the elements of the reproduction equipment, particularly when the receiver member is recirculated for forming a duplex reproduction. Some of release oil is then transferred from the receiver members onto the reproduction equipment elements, and may then potentially cause undesirable image defects on subsequently reproduced images.

SUMMARY OF THE INVENTION

In view of the above, this invention is directed to a fuser apparatus, for example having a pair of rollers in nip relation to transport a receiver member therebetween to permanently fix a marking particle image to such receiver member, a skive mechanism for stripping a receiver member adhering to a fuser apparatus roller from the roller, and a mechanism for applying a release oil to the fuser rollers. The skive mechanism includes a plurality of skive fingers formed as elongated, thin, flexible members located so as to engage the fuser apparatus rollers in a manner so as to substantially prevent damage to such associated fuser apparatus rollers. Each of the skive fingers have capillary micro-grooves formed therein for the purpose of channeling release oil away from the respective skive finger tips, thereby substantially eliminating image degradation by build up of the release oil.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
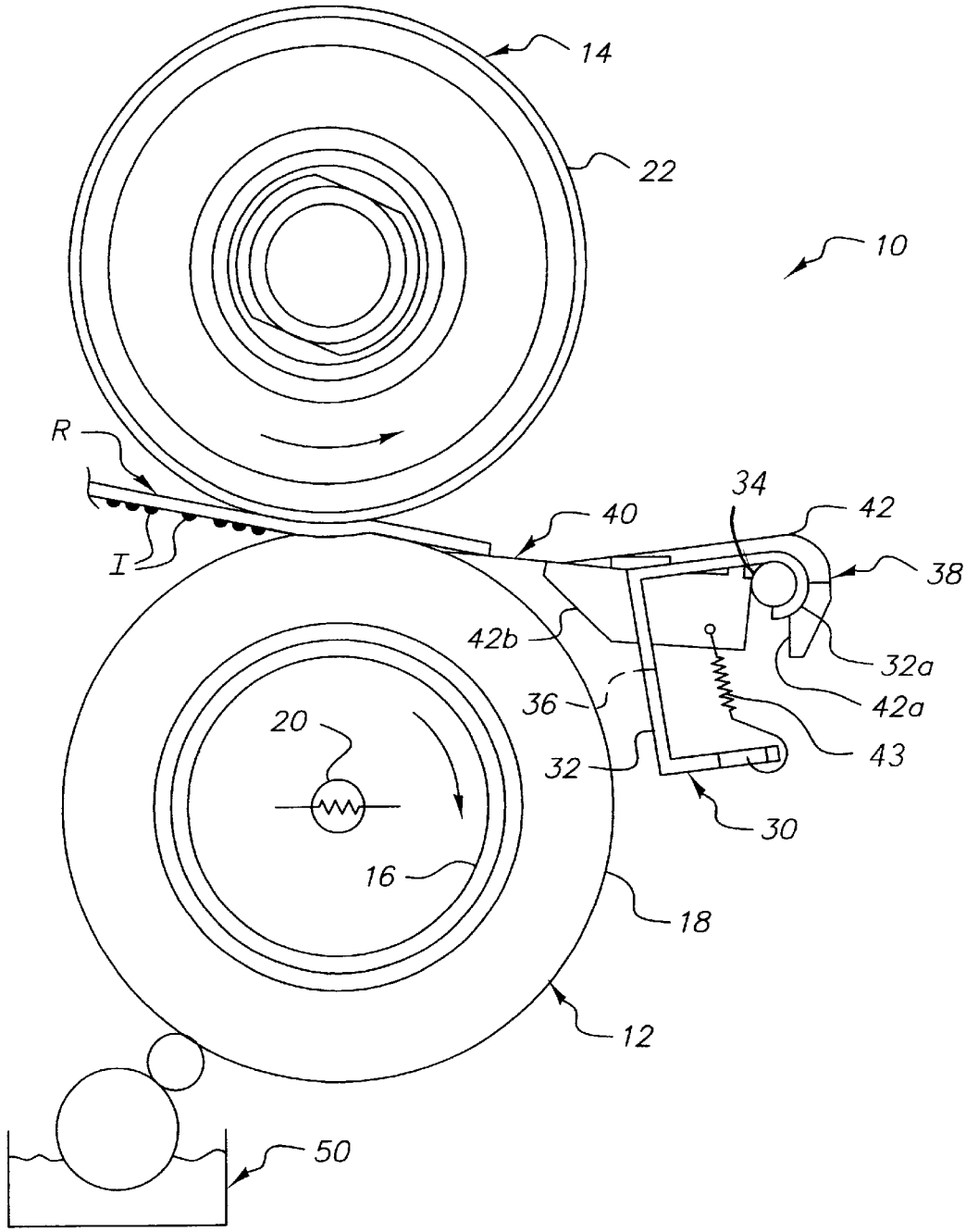
FIG. 1 is a side elevational view of a reproduction fuser apparatus having a receiver member skive assembly, according to this invention, with portions removed or broken away to facilitate viewing.

Referring now to the accompanying drawings, FIG. 1 shows a typical fuser apparatus, designated generally by the numeral 10, for a common commercial electrographic reproduction apparatus. The fuser apparatus 10 includes a fuser roller 12 in nip relation with a pressure roller 14. Rotation of the rollers by any suitable drive mechanism (not shown) will serve to transport a receiver member (designated for example by the letter R in FIG. 1), bearing a marking particle image I, through the nip under the application of heat and pressure. The receiver member may be, for example, a sheet of plain bond paper, or transparency material. The heat will soften the marking particles and the pressure will force the particles into intimate contact with each other and with the surface of the receiver material, such that the particles are at least partially imbibed into the receiver material fibers. Thus, when the marking particles cool, they are permanently fixed to the receiver member in an image-wise fashion.

The fuser roller 12 includes a core 16 with a cylindrical fusing blanket 18 supported on the core. The blanket 18 is typically made of a rubber material particularly formulated to be heat conductive or heat insulative depending upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12. Additionally, a suitable applicator device, designated generally by the numeral 50, is provided to coat the surface of the fusing blanket 18 with release oil. The release oil serves to further prevent the offsetting of marking particles to the fuser roller 12.

The pressure roller 14 has a hard outer shell 22. Typically, the shell 22 is made of metal, such as aluminum or steel for example. The shell 22 may also have a well known suitable surface coating (not shown) applied thereto to substantially prevent offsetting of the marking particle image to the pressure roller 14. Further, a cleaning assembly (not shown) may be provided to remove residual marking particle, paper fibers, and dust from the fuser apparatus rollers.

As noted above, under certain circumstances, such as when fusing heavy marking particle images, the receiver member may adhere to one or the other of the fuser apparatus rollers (i.e., fuser roller 12 or pressure roller 14). Therefore, a skive mechanism, designated generally by the numeral 30, is provided. The skive mechanism 30, shown in FIG. 1 in operative relation with the fuser roller 12, includes a frame 32, having a curved end 32*a*, mounted on a pivot rod 34. The pivot rod 34 has its longitudinal axis parallel to the longitudinal axis of the fuser roller 12, and extends for a length substantially equal to the length of the fuser roller. The frame 32 defines a plurality of openings 36 for a plurality of skive finger assemblies 38 respectively (see FIG. 2). A resilient member 43 (see FIG. 1), such as a coil spring, urges the frame 32 in a direction about the pivot rod 34 to maintain the skive assemblies of the skive mechanism in operative engagement with the fuser roller.

Each skive finger assembly 38 includes a skive finger 40 and a skive finger support 42. The skive finger 40 is formed as an elongated, substantially planar, relatively flexible element having a sharp chisel-like leading edge (for example, formed from a thin metal sheet). The skive finger support 42 is formed as a main body having features for capturing and supporting a skive finger. The body of the skive finger support 42 includes a slot 42*a* and a lead edge 42*b*. The slot 42*a* is adapted to be received on the pivot rod 34 to locate each skive finger support 42 adjacent to a respective opening 36 such that the skive fingers 40 extend through the openings toward the fuser roller 12. When the skive finger support 42 is mounted on the pivot rod 34, the action of the resilient member 43 causes the lead edge of the skive finger 40 to contact the fuser roller, and the lead edge 42*b* to be normally spaced from the fuser roller 12. However, during certain jam conditions as discussed, the skive finger support 42 will pivot about the rod 34 until the lead edge 42*a* of the support engages the fuser roller 12. By so limiting the action of the skive fingers 40, damage to the fuser roller 12, or the skive fingers themselves, is substantially prevented.

Figure 2:
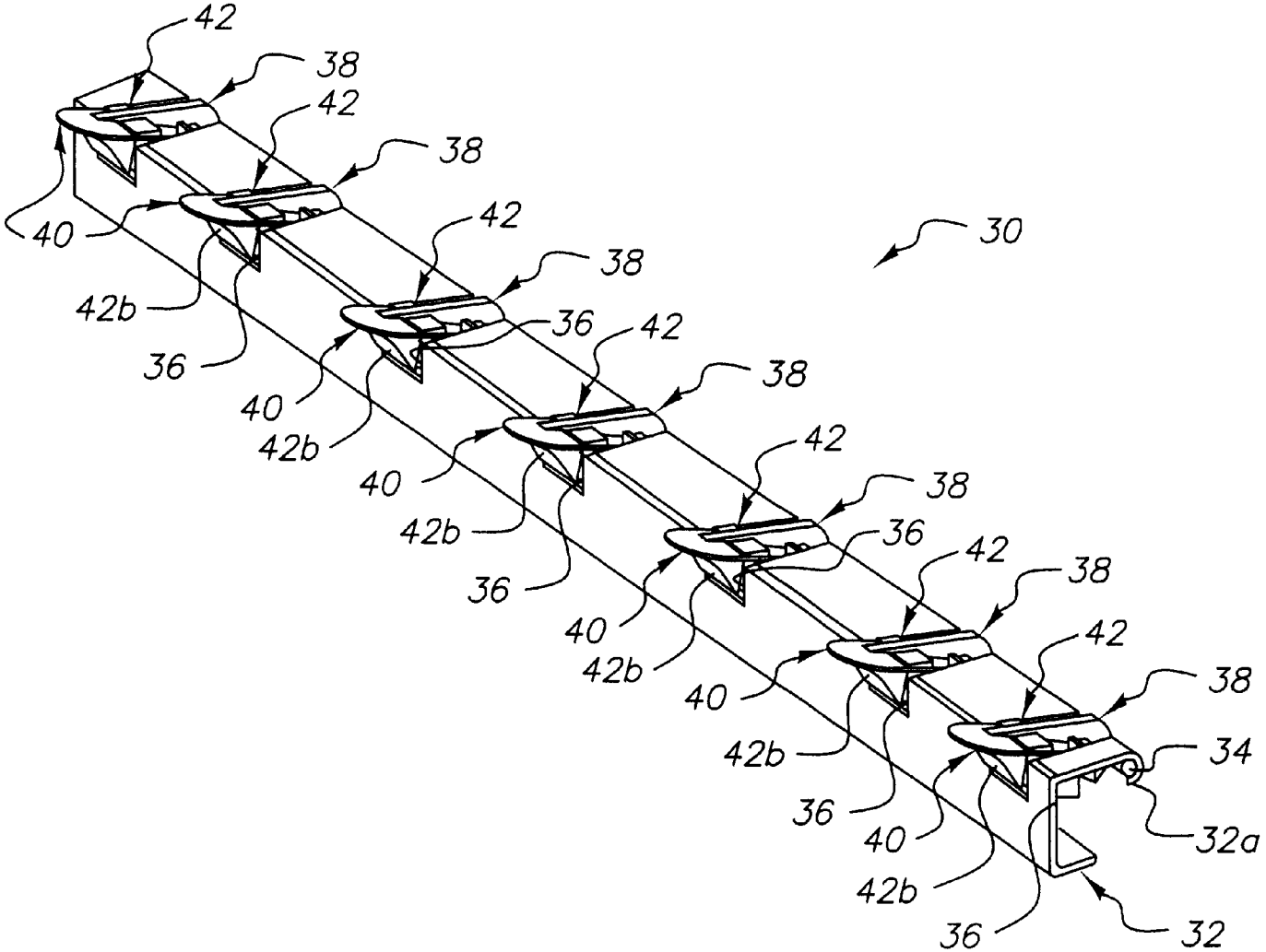
FIG. 2 is a view, in perspective, of the receiver member skive assembly of FIG. 1, with portions removed or broken away to facilitate viewing.

The skive fingers 40, as best shown in FIGS. 1 and 2, are of a particular preferred configuration best suited for engaging the roller of the fuser apparatus 10 which is relatively softer than the other nip-forming roller such that the nip shape is curved around the harder roller. Therefore, the receiver member on the exit from the nip is forced away from the skive finger-bearing softer roller. The thin flexible fingers could be placed very close to the nip (preferably 2 to 5 millimeters) under very low tip load (2 to 10 grams). The preferred skive fingers are long (free span 25 to 40 mms) and thin (0.1 to 0.13 mms). Because the skive fingers 40 are very thin, therefore, it is possible to place them very close to the fuser roller nip, and further when combined with the softer skive finger-bearing roller enables the skive fingers to work as guides rather than strippers for the receiver. Furthermore, when the skive fingers 40 are used as receiver member guides, a high tip force is not needed and thus roller surface damage is avoided.

As noted above, the skive fingers as currently found in exemplary fuser apparatus have a tendency during operation of the reproduction device to become wetted with fuser release oil that accumulates on the fingers during the fusing process. The receiver members, bearing images to be reproduced, as they are released from the fuser rollers, will come in contact with skive fingers as they are guided away from the fuser apparatus. The release oil then becomes wetted to the receiver members during such contact, and the oil is transported back through the elements of the reproduction device, particularly when the receiver member is recirculated for forming a duplex reproduction. Some of the release oil is then transferred off the receiver members onto the reproduction device elements, which may potentially cause undesirable image defects on subsequently reproduced images.

According to this invention, in order to reduce or eliminate the affect of release oil wetting of the receiver members, the probability that the oil will contact the receiver members is substantially reduced. This is accomplished by creating micro-groove channels 44 (see FIGS. 3–10) in the skive fingers 40 (some or all of the skive fingers in a skive mechanism 38) to allow oil that beads up and collects at the tips 40*a* of the skive fingers to be received in these channels and drain away. The skive fingers 40 are located so as to slope, by several degrees, from the fuser roller 12 (see FIG. 1). As such, gravity will be effective for moving the release oil liquid away from the skive finger/fuser roller interface. Additionally, the width of the micro-groove channels is selected to help cope with the oil variations that are encountered due to noises in the fusing process.

Another effect of the provision of the micro-groove channels 44 is that the channels create capillary action in the release oil which serves to aid in moving the release oil away from the skive finger tips. The micro-groove channels 44, formed by etching for example, may have a cross-sectional configuration of a rectangular, semi-circular, or V shape. Of course, the channels may alternatively be integrally formed with injection molded skive fingers. When the release oil in a channel exhibits a positive-pressure meniscus (i.e., a concave liquid/vapor interface), the result is an unstable liquid configuration. Accordingly the positive-pressure will urge the release oil down the channel away from the skive finger/fuser roller interface. This can occur in the corners of the micro-grooves, if the grooves are not completely filled with fluid, or over the cross-section of the entire groove. The micro-groove channels may also be tapered along their length, becoming narrower away from the skive finger tip as shown in the drawings, so that capillary action can occur, and such variable width serves to pull the release oil to the back of the skive finger for drainage.

Figure 3:
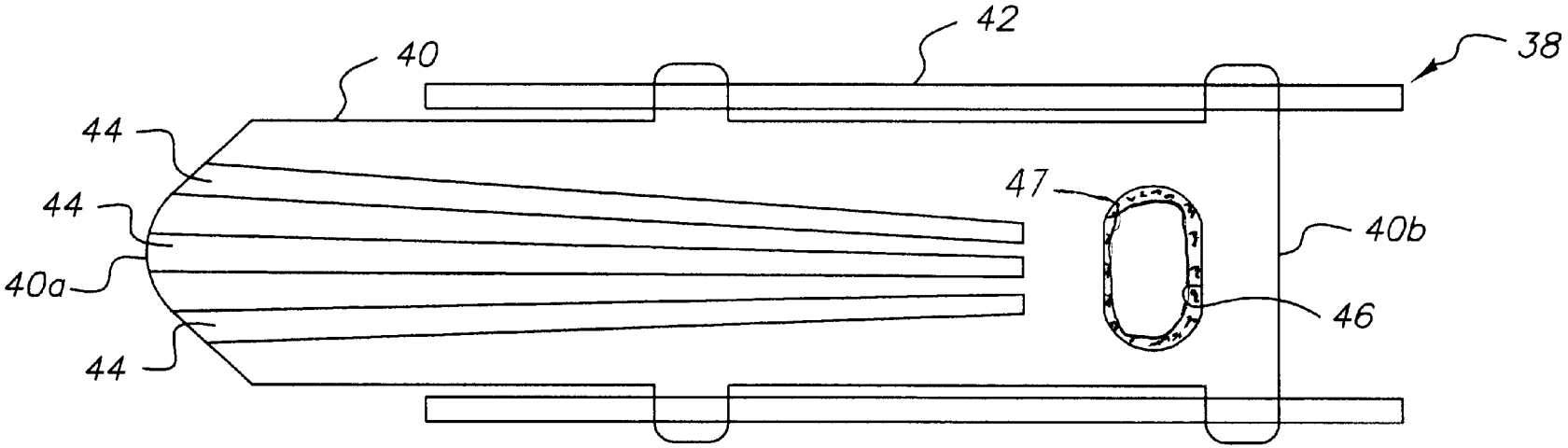
FIGS. 3–10 are respective top plan views, on an enlarged scale, of different embodiments of a receiver member skive finger, from the skive assembly as shown in FIG. 1, including capillary micro-grooves, according to this invention.
Figure 4:
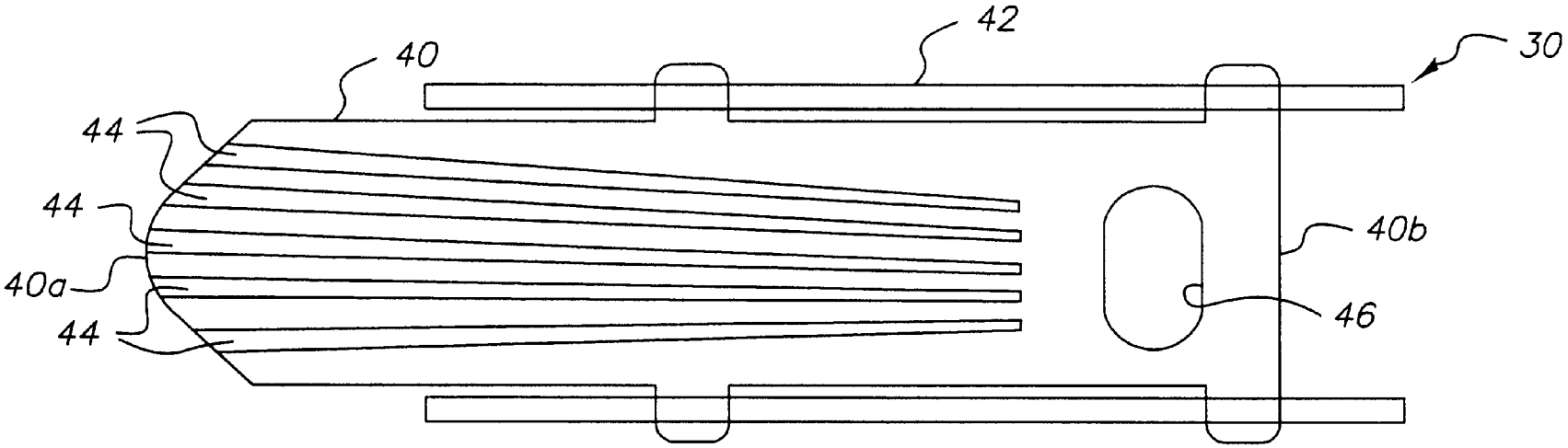
Figure 5:
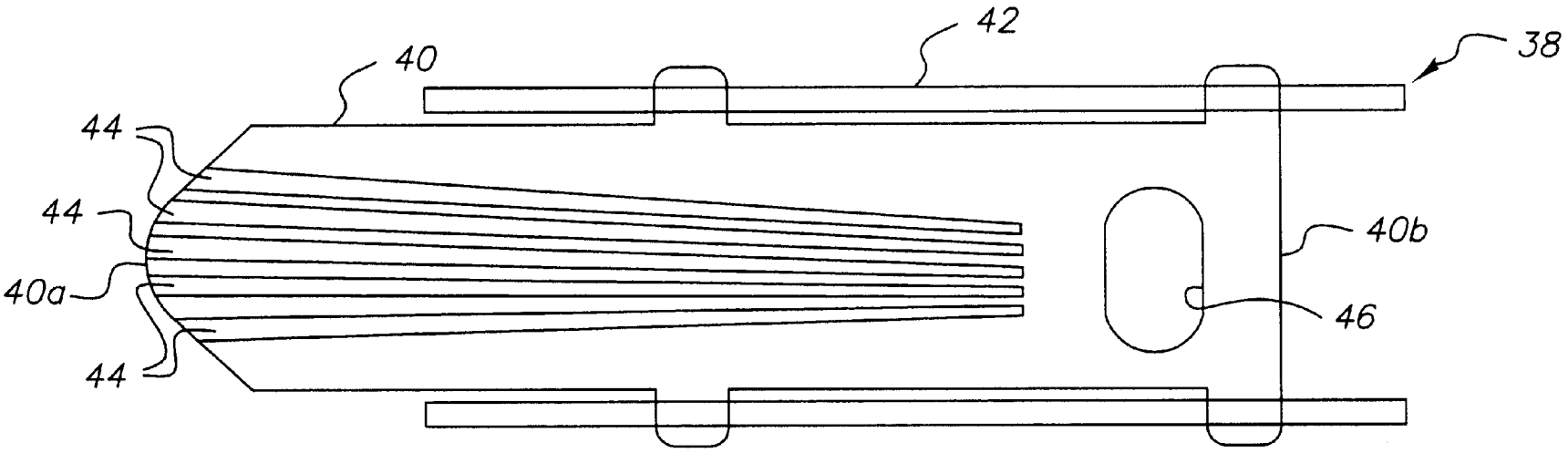
Figure 6:
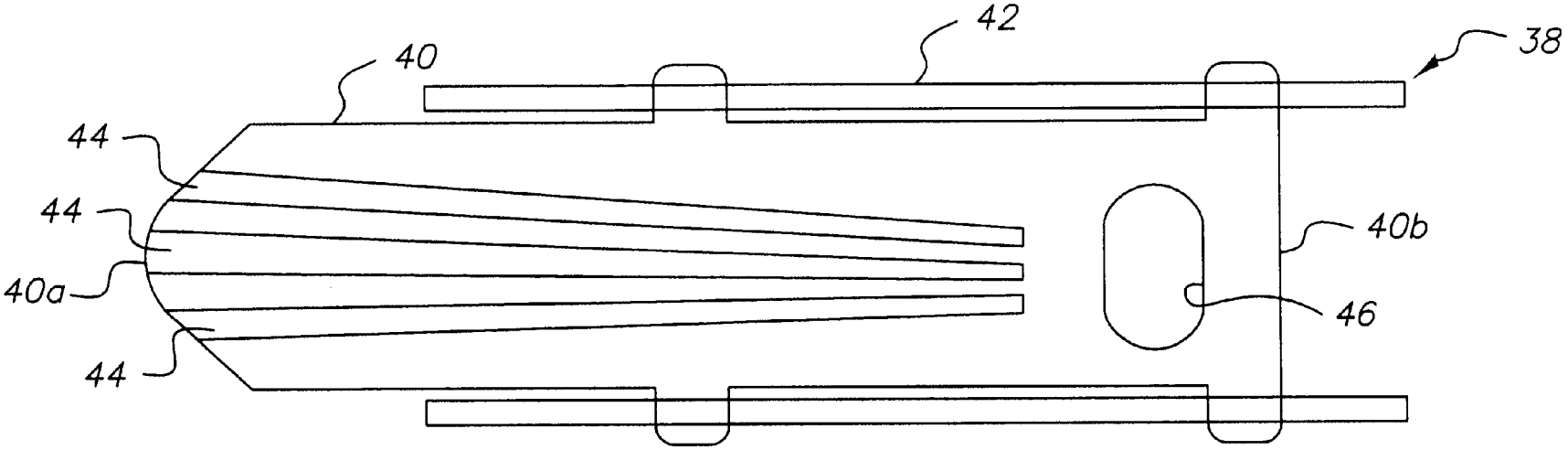
Figure 7:
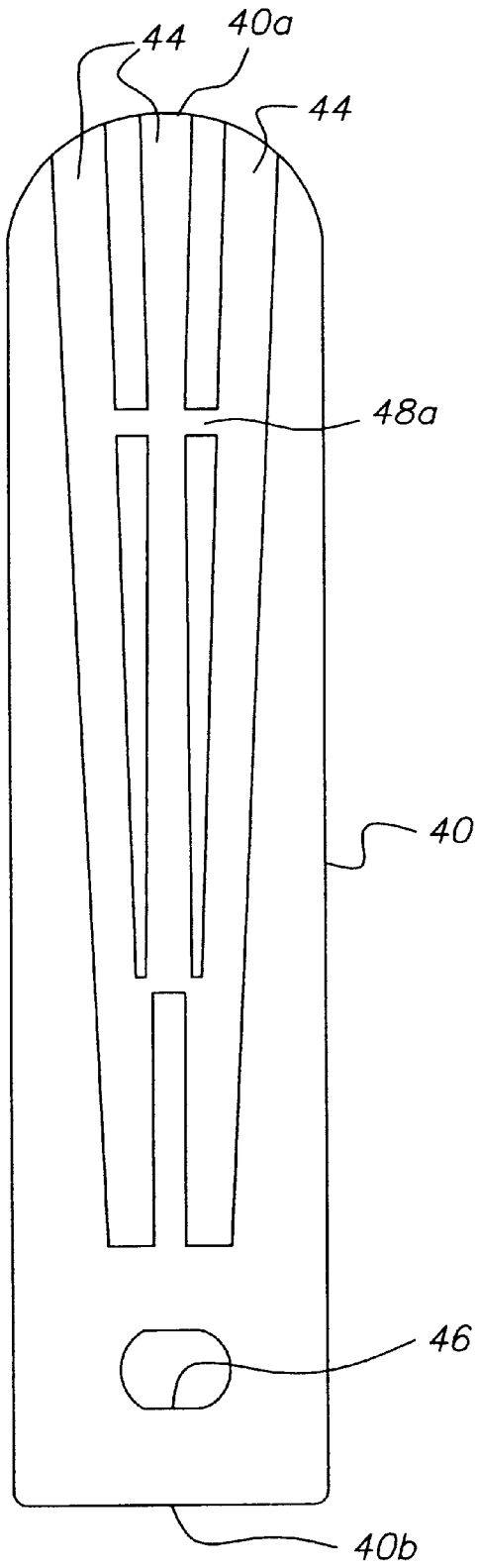
Figure 8:
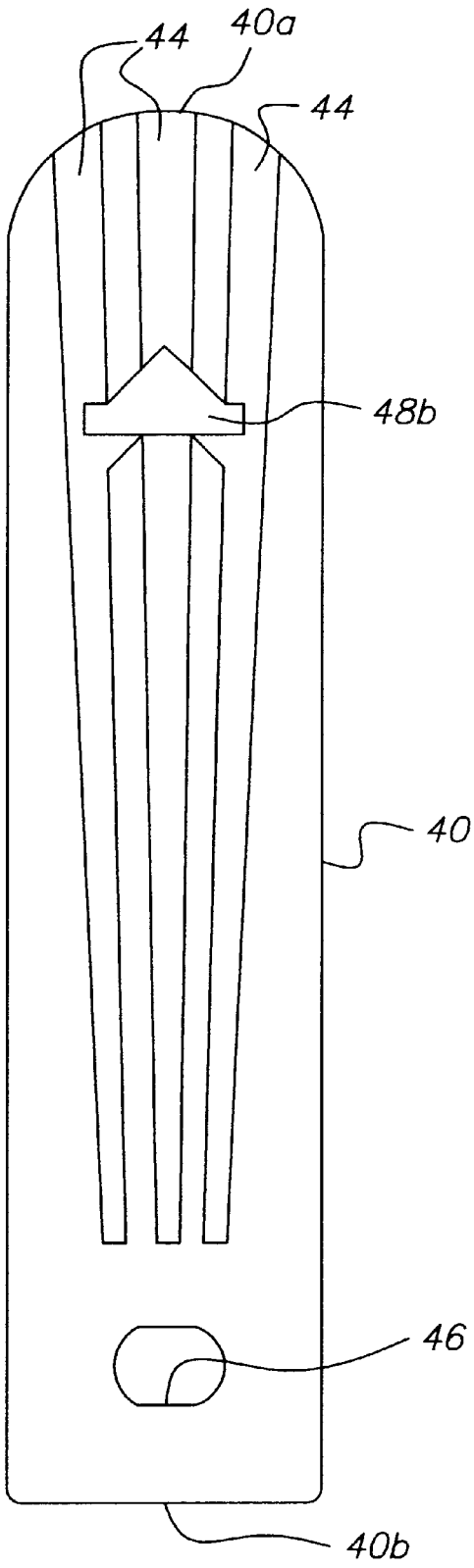
Figure 9:
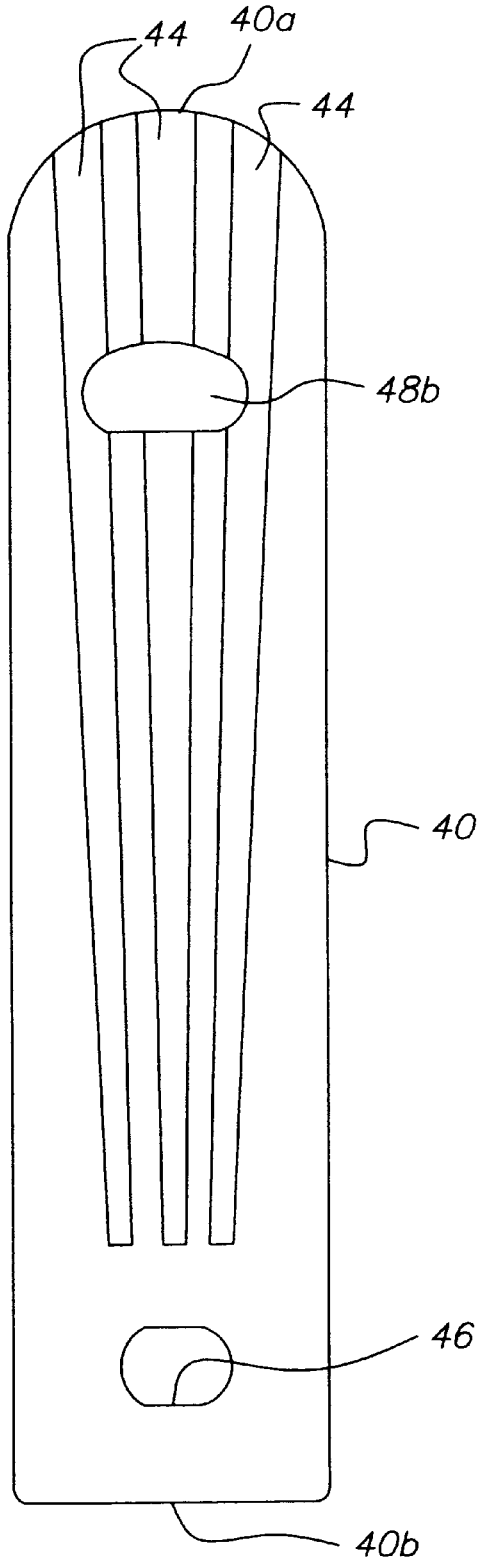
Figure 10:
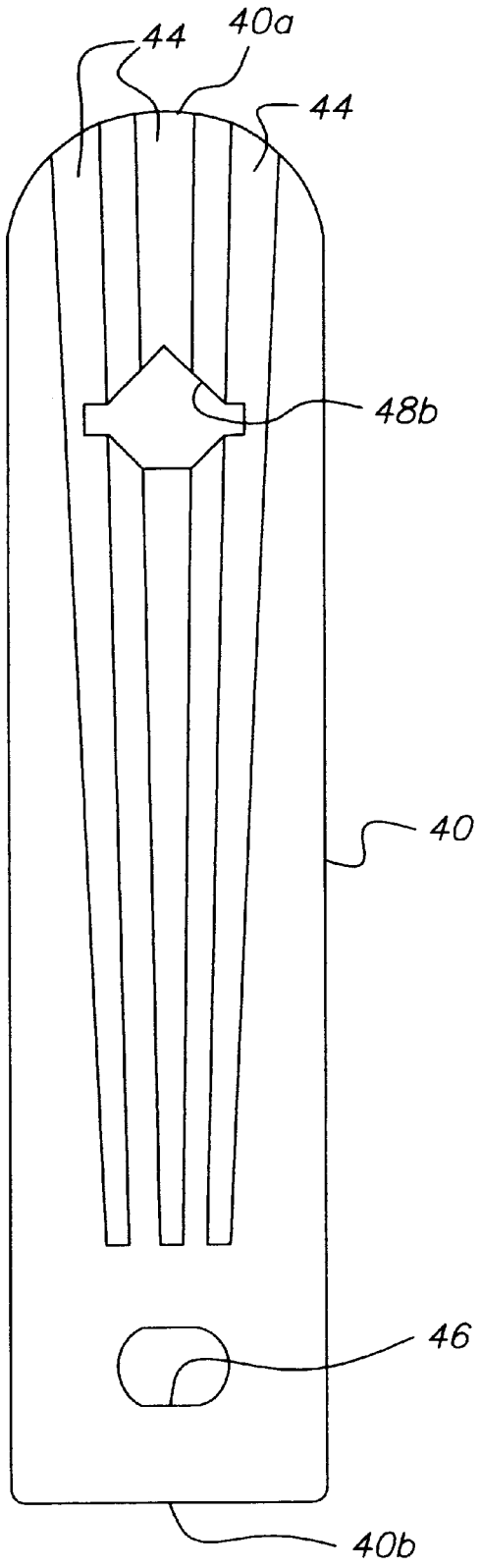

FIG. 3 shows an enlarged view of a single one of the skive finger assemblies 38 of the skive mechanism 30, with a skive finger 40 mounted on a support 42. Such assembly 38 may be located at any one, or more, of the assembly positions (shown in FIG. 2). According to a preferred embodiment of this invention, the plurality of micro-groove channels 44 of the skive finger 40 extend away from the lead edge tip 40*a* of the skive finger toward the end 40*b*. The channels 44 are approximately 1.4 mms wide by approximately 43 mms long. The depth of the etched channels 44 is approximately 40 ums, which is about half the thickness of the skive finger. Etching of the channels to a much deeper level is not recommended in that it can cause etching through the skive finger. Of course the particular described dimensions of the channels 44 are only exemplary and depend upon the specific geometry of the associated skive finger. An opening 46 is provided in the skive finger 40 adjacent to the end 40*b* of the skive finger, in juxtaposition with the terminus of the channels 44. The purpose of the opening 46 is to enable the skive finger to be secured on the support 42, such as for example by a post extending from the support.

The micro-groove channels 44 have a geometry, which is selected to best match the flow characteristics (including viscosity) of the particular release oil being used in the specific fuser apparatus 10. This will serve to facilitate feed of release oil away from the tip 40*a* of the skive finger toward the end 40*b* depending upon the physical arrangement and characteristics of the fuser apparatus 10 and the release oil. FIGS. 4–10 show different embodiments of the micro-groove channels formed in the skive fingers 40. As can be seen, there may be a wide variety of number, width (degree of taper of the channels), and orientation (angle relative to the longitudinal center-line of the skive finger) of the channels. Further the channels 44 may have transversely formed, interconnecting passages 48*a* (see FIG. 7), or holes 48*b* (see FIGS. 8–10). The particular configuration of the interconnecting passages 48*a* is to aid flow in the channels, while the openings 48*b* enable release oil received from the channels 44 to drip into, and be collected by, the frame 32 of the skive mechanism 30. Therefore the release oil will be collected remote from the transport path of the receiver members (R) and substantially prevented from contaminating other elements of the reproduction equipment. A wicking material, such as felt or Nomex, (for example, see element 47 in FIG. 3), may be urged into the opening 46 to enhancing wicking of the release oil away from the tip 40*a* of skive finger 40 via the channels 44.

The invention has been described in detail with particular reference to certain preferred embodiments thereof, but it will be understood that variations and modifications can be effected within the spirit and scope of the invention.

What is claimed is:

1. A fuser apparatus having a pair of rollers in nip relation to transport a receiver member therebetween and to permanently fix a marking particle image to such receiver member under application of heat and pressure, a release agent management system for applying a release agent to said pair of rollers, and a skive mechanism for stripping a receiver member adhering to one of said fuser apparatus rollers from such roller, said skive mechanism comprising:

a frame located in spaced relation with one of said rollers of said pair of fuser apparatus rollers, a plurality of skive assemblies mounted on said frame, each of said skive assemblies including a skive finger and a support body for supporting said skive finger in operative relation to said one of said rollers, said skive finger being an elongated, thin, flexible member, a plurality of capillary micro-groove channels, and at least one channel communicating between said capillary micro-groove channels, whereby build up of release agent is substantially prevented.

2. The skive mechanism of claim 1 wherein said respective skive fingers have a tip adjacent to said one of said rollers and an end remote from said tip, and said plurality of capillary micro-groove channels extending from said tip toward said remote end.

3. The skive mechanism of claim 2 wherein said respective skive fingers define an opening adjacent to said remote end to enable said skive finger to be supported in said skive mechanism.

4. The skive mechanism of claim 3 wherein said capillary micro-groove channels terminate adjacent to said defined opening.

5. The skive mechanism of claim 2 wherein said respective skive fingers define an opening communicating between said capillary micro-groove channels.

6. The skive mechanism of claim 5 wherein a wicking material extends into said defined opening.

7. A receiver member stripping skive finger for a skive mechanism of a fuser apparatus having a pair of rollers in nip relation to transport a receiver member therebetween and to permanently fix a marking particle image to such receiver member under application of heat and pressure, and a release agent management system for applying a release agent to said pair of rollers, said skive finger comprising:

an elongated, thin, flexible member, and a plurality of capillary micro-groove channels, and at least one channel communicating between said micro-capillary groove channels, whereby build up of release agent is substantially prevented.

8. The skive finger of claim 7 wherein said flexible member has a tip, adapted to be located adjacent to said one of said fuser apparatus rollers, and an end remote from said tip, and said plurality of capillary micro-groove channels extending from said tip toward said remote end.

9. The skive finger of claim 8 wherein said flexible member defines an opening communicating between said capillary micro-groove channels.

10. The skive finger of claim 9 wherein a wicking material extends into said defined opening.

* * * * *